US011627804B2

(12) United States Patent
Kondziela

(10) Patent No.: US 11,627,804 B2
(45) **Date of Patent: *Apr. 18, 2023**

(54) ERGONOMIC MULTI-POSITIONABLE WORKSTATION

(71) Applicant: James Mark Kondziela, Stamford, CT (US)

(72) Inventor: James Mark Kondziela, Stamford, CT (US)

(73) Assignee: Lucca Ventures, Inc., Southington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/570,923

(22) Filed: Jan. 7, 2022

(65) Prior Publication Data

US 2022/0125197 A1 Apr. 28, 2022

Related U.S. Application Data

(63) Continuation of application No. 17/470,420, filed on Sep. 9, 2021, now Pat. No. 11,219,311.

(60) Provisional application No. 63/088,322, filed on Oct. 6, 2020.

(51) Int. Cl.
*A47B 83/02* (2006.01)
*A47B 21/04* (2006.01)

(52) U.S. Cl.
CPC ..... *A47B 83/02* (2013.01); *A47B 21/04* (2013.01); *A47B 2083/025* (2013.01); *A47B 2200/0035* (2013.01); *A47B 2200/0072* (2013.01); *A47B 2200/0097* (2013.01); *A47B 2220/0077* (2013.01)

(58) Field of Classification Search
CPC ... A47B 83/02; A47B 21/00; A47B 2083/025; A47B 2200/0035; A47B 2200/0072; A47B 2200/0096; A63G 1/00
USPC ..... 297/327, 217.1, 217.5; 472/47
See application file for complete search history.

(56) References Cited

U.S. PATENT DOCUMENTS

| | | | |
|---|---|---|---|
| 4,856,771 | A | 8/1989 | Nelson et al. |
| 5,060,932 | A | 10/1991 | Yamaguchi |
| 5,489,142 | A | 2/1996 | Mathieu |

(Continued)

FOREIGN PATENT DOCUMENTS

| | | | |
|---|---|---|---|
| BR | 0504975 | A | 8/2007 |
| CN | 201418510 | Y | 3/2010 |

(Continued)

OTHER PUBLICATIONS

Signature Altwork Station. Product Catalog [online]. Altwork, LLC [retrieved on Jun. 25, 2020]. Retrieved from the Internet: <URL: https://altwork.com/products/signature-series?variant=31617924366426>.

(Continued)

*Primary Examiner* — Jose V Chen
(74) *Attorney, Agent, or Firm* — Wiggin and Dana LLP

(57) ABSTRACT

The present invention provides an ergonomic multi-positionable workstation having independently positionable and adjustable seating and work area components. The seating components can further comprise back, leg support, and head support components, and the work area components can further comprise a work surface or desk area and areas for accommodating a computer keyboard and monitor.

24 Claims, 26 Drawing Sheets

(56) References Cited

U.S. PATENT DOCUMENTS

| | | | | |
|---|---|---|---|---|
| 5,489,212 | A | 2/1996 | Masao | |
| 5,725,435 | A | 3/1998 | De Castro Faria | |
| 6,017,276 | A | 1/2000 | Elson et al. | |
| 6,056,363 | A | 5/2000 | Maddox | |
| 6,672,225 | B2 | 1/2004 | Pomodoro | |
| 7,100,517 | B1 | 9/2006 | Godwin | |
| 7,134,719 | B2 | 11/2006 | Moglin et al. | |
| 8,087,724 | B2 | 1/2012 | Kosik et al. | |
| 8,615,828 | B2 | 12/2013 | Schermel | |
| 8,939,500 | B2 | 1/2015 | Voigt et al. | |
| 9,220,348 | B2 | 12/2015 | Stieler et al. | |
| 9,591,921 | B2 | 3/2017 | Valdivia | |
| 9,789,411 | B2 | 10/2017 | Masutti | |
| 10,293,265 | B1 | 5/2019 | Freedman et al. | |
| 10,531,737 | B2 | 1/2020 | Jones et al. | |
| 10,832,490 | B2 | 11/2020 | Jung | |
| 10,947,719 | B1 | 3/2021 | Wodecki et al. | |
| 11,219,311 | B1 * | 1/2022 | Kondziela ..... | A47B 83/02 |
| 2009/0206641 | A1 | 8/2009 | Brown, Jr. | |
| 2011/0031788 | A1 | 2/2011 | Kosik et al. | |
| 2014/0084642 | A1 | 3/2014 | Park | |
| 2014/0087334 | A1 | 3/2014 | Schlusselberger | |
| 2016/0195923 | A1 | 7/2016 | Nauseef et al. | |

FOREIGN PATENT DOCUMENTS

| | | | |
|---|---|---|---|
| DE | 202006003793 | U1 | 9/2007 |
| DE | 202015100223 | U1 | 5/2015 |
| DE | 102014115796 | A1 | 4/2016 |
| KR | 20040071049 | | 8/2004 |
| RU | 2209022 | C2 | 7/2003 |
| RU | 2290157 | C2 | 12/2006 |
| WO | 2011044602 | A1 | 4/2011 |
| WO | 2011108957 | A1 | 9/2011 |

OTHER PUBLICATIONS

Written Opinion of the International Searching Authority and International Search Report for International Application No. PCT/US2021/049607, dated Dec. 28, 2021 (11 pp).

* cited by examiner

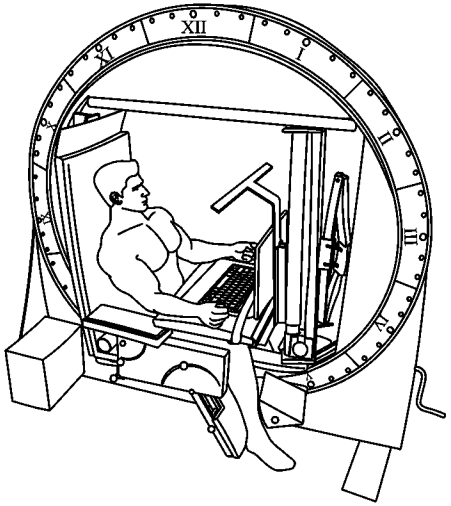
FIG. 3B
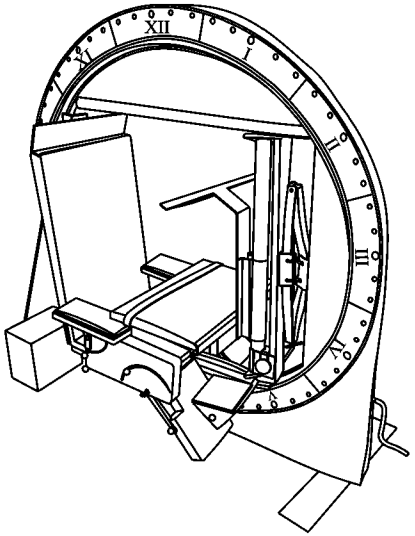
FIG. 3A
FIG. 3

Position 5: Supine/Lying Down

Position 6: Preched/Leaning

Bottom View

Top View

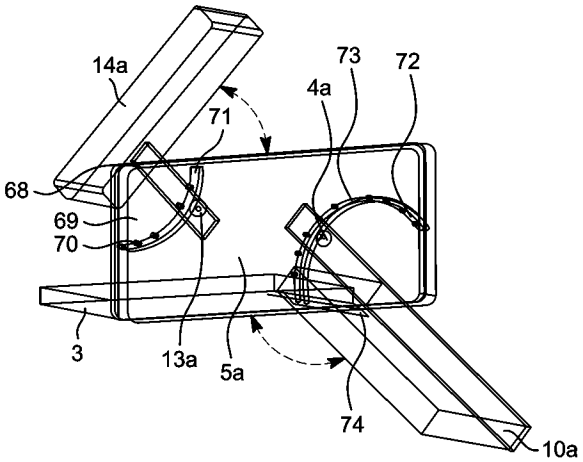
FIG. 17B
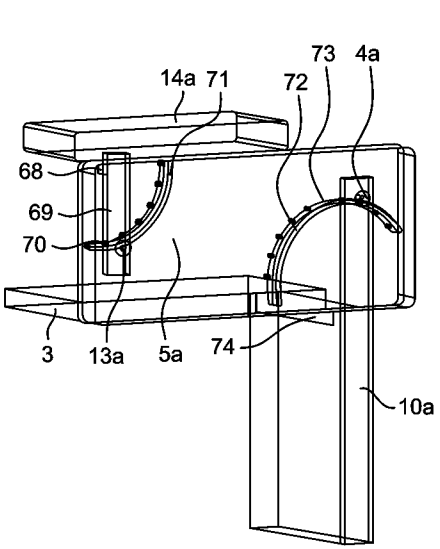
FIG. 17A
FIG. 17

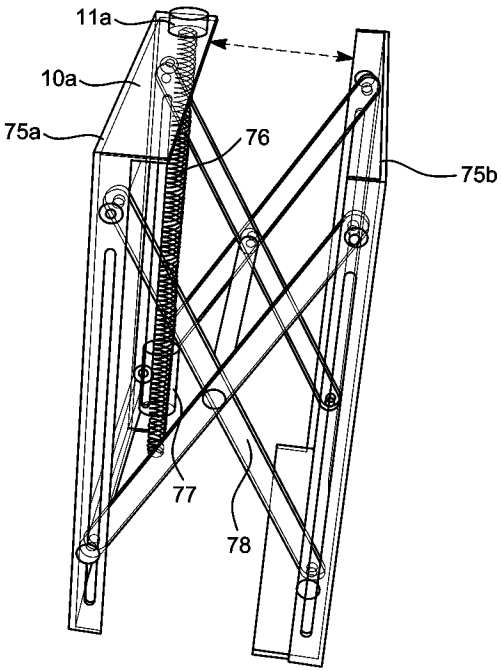
FIG. 18B
FIG. 18
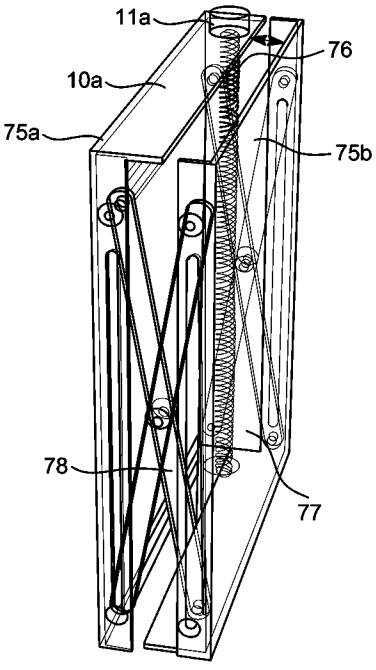
FIG. 18A

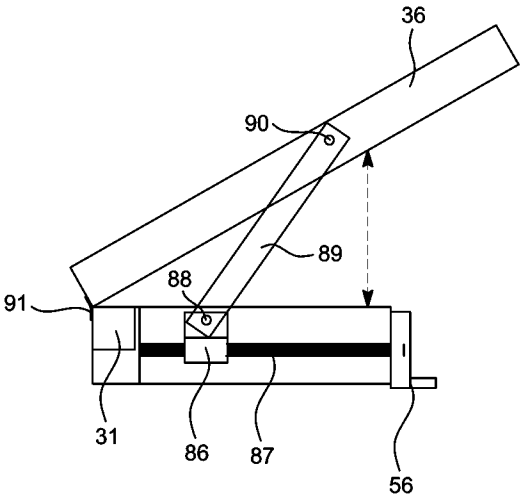
FIG. 20B
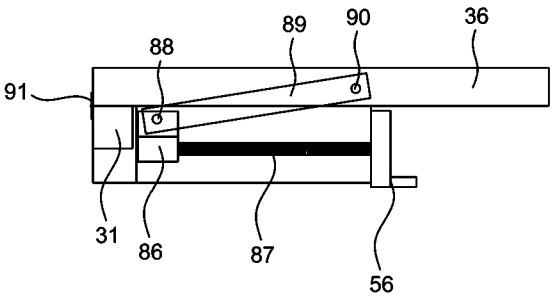
FIG. 20A
FIG. 20

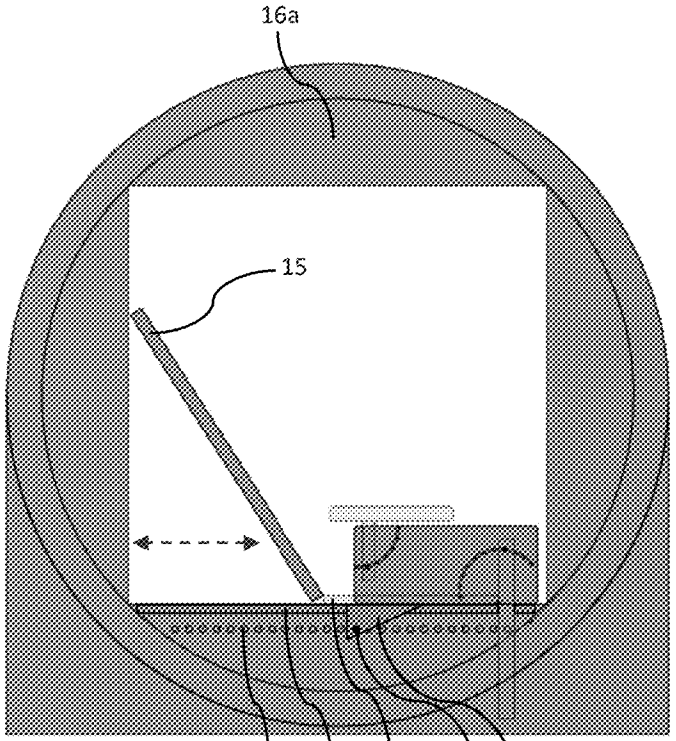
FIG. 22B
FIG. 22
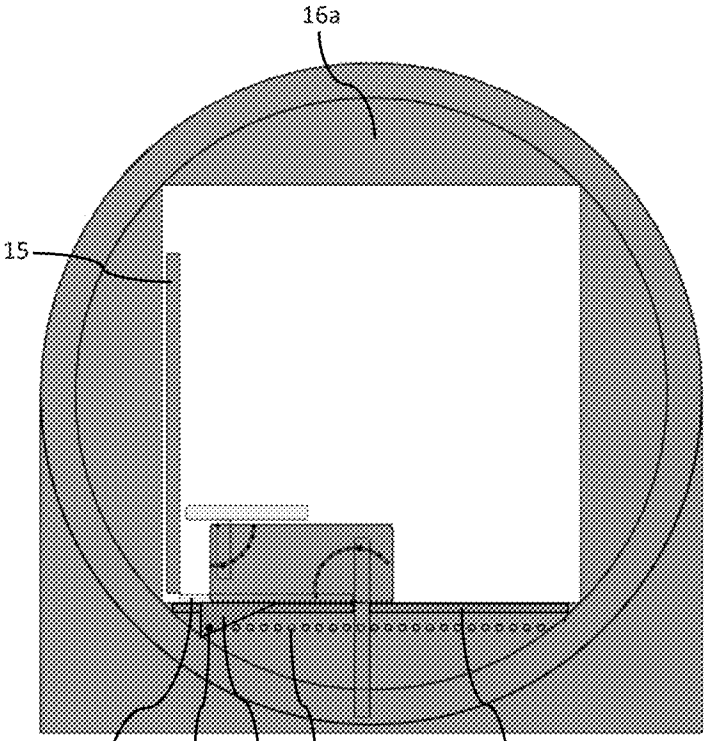
FIG. 22A

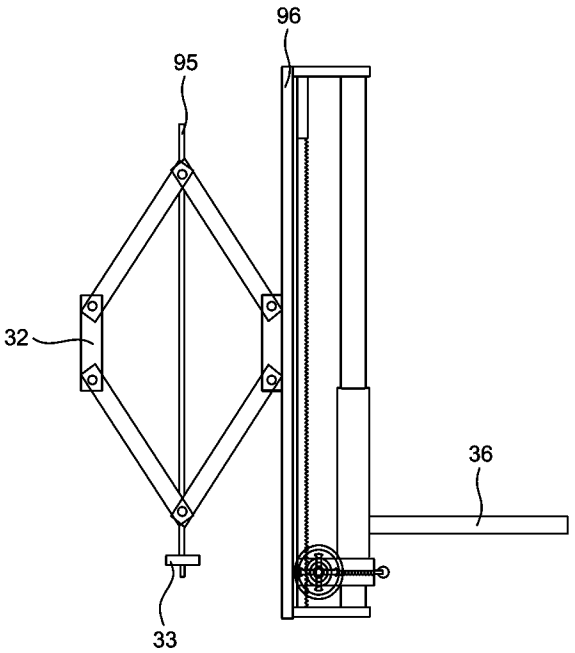
FIG. 23B
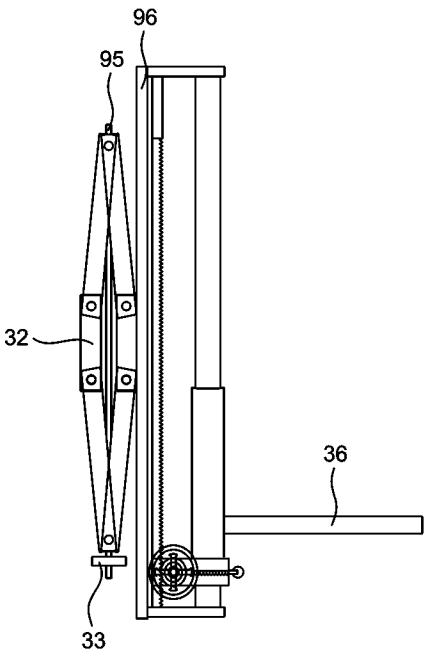
FIG. 23A
FIG. 23

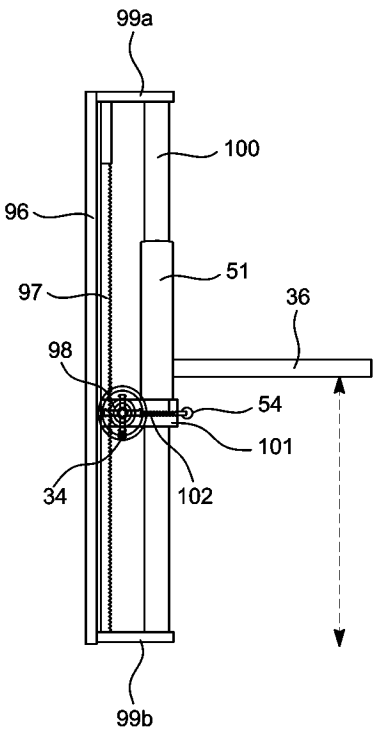
FIG. 24B
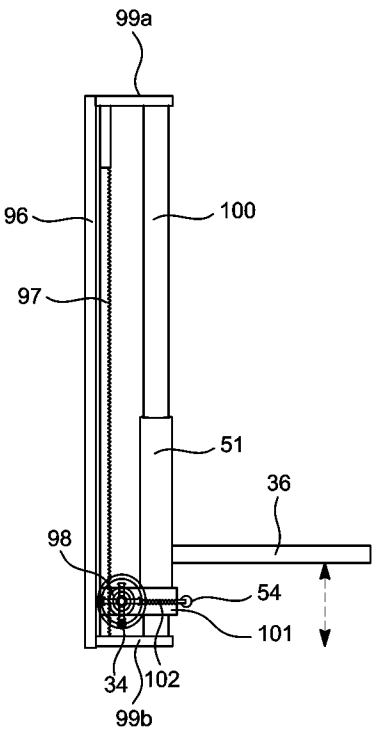
FIG. 24A
FIG. 24

ERGONOMIC MULTI-POSITIONABLE WORKSTATION

CROSS REFERENCE TO RELATED APPLICATIONS

This application is a continuation of U.S. patent application Ser. No. 17/470,420 filed Sep. 9, 2021, which claims the benefit under 35 U.S.C. § 119(e) of U.S. Provisional Application No. 63/088,322 filed Oct. 6, 2020, all of which are herein incorporated by reference in their entirety.

FIELD OF THE INVENTION

The present invention provides an ergonomic multi-positionable workstation having independently positionable and adjustable seating and work area components. The seating components can further comprise back, leg support, and head support components, and the work area components can further comprise a work surface or desk area and areas for accommodating a computer keyboard and monitor. The independently positionable and adjustable feature of the workstation is achieved via separate support rings for the seating and the work area, such that the support rings are each independently rotatable with respect to each other and with respect to a support frame for the rings.

BACKGROUND OF THE INVENTION

In the home, office, and elsewhere, chairs and tables are used for many purposes, and there has been a dramatic rise in their use as computing technology has transformed an expanding portion of the worldwide economy into an information economy. This trend has accelerated as consumers have increasingly attended to the Internet in all its forms for sundry activities (e.g., search, news, entertainment, education, at-work activities, remote work activities, video streaming, audio streaming, social media, gaming). Indeed, all use metrics consistently underscore that, worldwide, people are attending increasingly to computer "screen" technology in all its forms, whether it be on desktop computers, laptop computers, notebook computers, tablet computers (e.g., iPads), smartphones, electronic reading devices (e.g., Kindles) or other devices—in addition to conventional and intelligent televisions that incorporate computing and internet services within them.

As a result of this accelerating worldwide demand for, and consumption of, such screen devices and services, especially as these devices and services relate to the Internet, the need for ergonomic chairs and tables—for both health and comfort—has never been greater. Numerous studies consistently show that, worldwide, people are spending ever-greater amounts of time sitting and interacting with all these computers, smartphones, and intelligent televisions and other devices. Public health officials have regarded this worldwide trend with alarm, frequently noting the many health risks associated with these lengthy sedentary activities, including back pain, neck pain, repetitive stress injuries, eyestrain and other vision problems, as well as long-term increased risk of heart attacks, strokes, and cancer.

Unfortunately, despite the great and growing demand for the most ergonomic chairs, tables, and, when combined, workstations to accommodate this worldwide trend and alleviate health problems and increase comfort, advances in workstation ergonomics have been limited. First, chairs and tables are often, and even usually, sold separately, inviting ergonomic mismatch when combined. Second, chairs themselves are largely limited in their range of motion to upright sitting and reclining positions, and tables often have their heights fixed. Third, even conventional workstations, which advantageously integrate a chair with a table, have been limited in their range of motion and other ergonomic positioning, as well as their accommodation to individual human preferences and anthropometrics. Fourth and moreover, even advanced and very expensive workstations remain limited in range of motion, ergonomic positioning, adjustability, and ready accommodation to the plethora of computing, smartphone, and intelligent television devices in use.

It has been found that the ergonomic workstation of the present invention accommodates and benefits an exceptionally broad range of human positioning, human activities, and new and old technologies due to (1) its two independently operational rotating rings for positioning the chair and work area components, (2) the many manual adjustments available in the various embodiments for ergonomic comfort and anthropometric fit, (3) configurations with electrical panels with standard ports and outlets that enable ready use with a plethora of devices, and (4) simple user control panels for ease of operation and use.

In terms of breadth of human positioning, the present invention enables at least eight distinct positions and features, including sitting, leaning back, supine, astronaut, inversion, perched, standing, and rocking, as well as a continuum of variations for each of these positions. In terms of breadth of human activities, the present invention readily accommodates and benefits (1) work, (2) entertainment (e.g., video gaming, movie binging), (3) rest and relaxation (e.g., short naps, long periods of rest), and even (4) health and healing (e.g., using inversion to alleviate back compression and pain). In terms of breadth of new and old technologies, the present invention accommodates and benefits not only the latest computing and video technologies but also "old school" activities, such as reading books (with or without bookstands affixed to the invention), drawing and painting on paper or canvasses (with or without easels attached to the invention), writing checks, and knitting and other arts and crafts. The present invention enables full inversion (hanging upside down in a fully vertical position perpendicular to the floor) and an automated rocking chair motion. With respect to these positions and features, the present invention provides for the independent positioning and adjustment of the seating and work areas with respect to each other, to provide for a wide range of positions for the user. As a consequence, the present invention transcends other dedicated, sole-use inversion tables and rocking chairs sold commercially today, thereby providing benefits for a healthy work environment and comfort as well.

SUMMARY OF THE INVENTION

The present invention provides an ergonomic multi-positionable workstation that is capable of being adjusted to accommodate a wide range of positions. A feature of the workstation is that it has independently positionable and adjustable seating and work area components. The seating components can further comprise back, leg support, and head support components, and the work area components can further comprise a work surface or desk area and areas for accommodating a computer keyboard and monitor. The independently positionable and adjustable feature of the workstation is achieved via separate support rings for the seating and the work area, such that the support rings are each independently rotatable with respect to each other and with respect to a support frame for the rings.

The present invention provides an ergonomic multi-positionable workstation, comprising:

a) a base;

b) a stationary frame;

c) a first rotatable support ring;

d) a second rotatable support ring;

e) a seat comprising a backrest, for example where the seat and backrest are adjustable and adjustable with respect to each other; and f) a support for a work surface, a keyboard, or both, for example where the support for the work surface is adjustable;

wherein the stationary frame b) is attached to the base a);

wherein the seat e) is attached to the first rotatable support ring c);

wherein the support for the work surface, keyboard, or both f) is attached to the second rotatable support ring d); and wherein the first rotatable support ring c) and the second rotatable support ring d) are each supported by and rotatable with respect to the frame, and are each independently rotatable with respect to each other.

In another aspect the present invention provides a workstation further comprising:

g) a support for a monitor, where the support for the monitor is adjustable;

wherein the support for the monitor g) is attached to the second rotatable support ring d); and wherein the support for the work surface, keyboard, or both f) and the support for the monitor g) are each independently adjustable with respect to each other.

In another aspect the present invention provides a workstation wherein the first rotatable support ring c) and the second rotatable support ring d) are each rotatable 360 degrees in either direction about an axis perpendicular to planes defined by the circumferences of each of the rotatable support rings.

In another aspect the present invention provides a workstation further comprising one or more drive mechanisms h) for rotating the first rotatable support ring c) and the second rotatable support ring d).

In another aspect the present invention provides a workstation wherein the drive mechanism is selected from electrical drive mechanisms, mechanical drive mechanisms, and combinations thereof.

In another aspect the present invention provides a workstation wherein the electrical drive mechanism comprises one or more chains, sprockets, and electric gearbox motors.

In another aspect the present invention provides a workstation wherein the electrical drive mechanism further comprises one or more belts, rollers, and electric gearbox motors.

In another aspect the present invention provides a workstation wherein the electrical drive mechanism further comprises one or more racks, pinions, and electric gearbox motors.

In another aspect the present invention provides a workstation wherein the electrical drive mechanism further comprises a plurality of teeth located on the first rotatable support ring c) and the second rotatable support ring d), one or more gears for engaging the teeth and moving the rotatable support rings, and electric gearbox motors.

In another aspect the present invention provides a workstation wherein the mechanical drive mechanism comprises one or more manual cranks and shafts.

In another aspect the present invention provides a workstation wherein the drive mechanism further comprises a braking means.

In another aspect the present invention provides a workstation according further comprising one or more rollers, bearings, or v-grooved wheels or rings i) on which the first rotatable support ring c) and the second rotatable support ring d) are supported.

In another aspect the present invention provides a workstation wherein the first rotatable support ring c) and the second rotatable support ring d) are each contained within or partially contained within the support frame.

In another aspect the present invention provides a workstation wherein the one or more rollers, bearings, or v-grooved wheels or rings i) are contained within the support frame. The rollers, bearings, or v-grooved wheels or rings provide support for the support rings to allow for and facilitate the desired motion of the support rings. Each support ring is independently rotatable because each support ring rests on rollers, bearings, or v-grooved wheels or rings, and is rotated by its own chain and sprocket connected to its own electric motor (therefore there are 2 electric motors), which the user can control independently using the armrest controls (RIGHT armrest controls move RIGHT ring forward and backward, while LEFT armrest controls move LEFT ring backward and forward).

In another aspect the present invention provides a workstation further comprising a means j) for preventing collision of the seat a), the support for a work surface, a keyboard or both f), and the support for a monitor g), with each other and/or with a user of the workstation and/or with the floor or surface on which the workstation is positioned In another aspect the present invention provides a workstation wherein said means j) for preventing collisions comprises one or more sensors.

In another aspect the present invention provides a workstation wherein the seat e) further comprises armrests.

In another aspect the present invention provides a workstation wherein the seat e) further comprises leg rests, footrests, or a combination thereof.

In another aspect the present invention provides a workstation according further comprising a means for gripping or restraining the ankles or lower extremities of a user k), particularly when the workstation is positioned such that the user is suspended or reclined within the workstation.

In another aspect the present invention provides a workstation further comprising one or more control panels l).

In another aspect the present invention provides a workstation wherein the one or more control panels l) are located on the armrests.

In another aspect the present invention provides a workstation further comprising a computerized control system m).

In another aspect the present invention provides a workstation wherein the base a) further comprises one or more wheels or rollers n) to facilitate moving of the workstation.

In another aspect the present invention provides a workstation further comprising an illumination source o) to illuminate the work area.

These and other aspects of the present invention will become apparent from the disclosure herein.

BRIEF DESCRIPTION OF THE DRAWINGS

FIGS. 3A and 3B are photographs showing perspective views of a 1:12 scale model (one inch to one foot) of the workstation both without (FIG. 3A) and with (FIG. 3B) a mannequin seated within the workstation.

FIGS. 12A1, 12A2, 12B1, and 12B2 are side views showing various components of the workstation. FIG. 12A1 is a left side view drawing (the left side of the workstation is defined as the side of the workstation corresponding to the left of a user that would be positioned within). FIG. 12A2 is a photograph showing a planar view of a 1:12 scale model (one inch to one foot) of the workstation in the same orientation as in FIG. 12A1. FIG. 12B1 is a right side view drawing (the right side of the workstation is defined as the side of the workstation corresponding to the right of a user positioned within). FIG. 12B2 is a photograph showing a planar view of a 1:12 scale model (one inch to one foot) of the workstation in the same orientation as in FIG. 12B1.

FIGS. 13A1, 13A2, 13B1, and 13B2 are front and back views showing various components of the workstation. FIG. 13A1 is a front view drawing (the front of the workstation is defined as the side of the workstation corresponding to the direction of the front of a user positioned within). FIG. 13A2 is a photograph showing a front view of a 1:12 scale model (one inch to one foot) of the workstation in the same orientation as in FIG. 13A1. FIG. 13B1 is a back (rear) view drawing [the back (rear) of the workstation is defined as the side of the workstation corresponding to the back of a user positioned within]. FIG. 13B2 is a photograph showing a back (rear) view of a 1:12 scale model (one inch to one foot) of the workstation in the same orientation as in FIG. 13B1.

FIGS. 14A1, 14A2, 14B1, and 14B2 are top and bottom views showing various components of the workstation. FIG. 14A1 is a top view drawing (the top view is defined from the perspective of a viewer looking down upon the workstation). FIG. 14A2 is a photograph showing a top view of a 1:12 scale model (one inch to one foot) of the workstation in the same orientation as in FIG. 14A1. FIG. 14B1 is a bottom view drawing (the bottom view is defined from the perspective of a viewer looking up into the workstation if positioned below the workstation. FIG. 14B2 is a photograph showing a bottom view of a 1:12 scale model (one inch to one foot) of the workstation in the same orientation as in FIG. 14B1.

FIGS. 17A and 17B are perspective drawings showing manual adjustment mechanism details for the arm rest and leg rest. In FIG. 17A the arm rest and leg rest are in the regular/conventional, i.e. baseline position. FIG. 17B illustrates the movement of the arm rest and the leg rest.

FIGS. 18A and 18B are perspective drawings showing the manual adjustment scissor mechanism details (not shown in prior figures) for the leg rest. In FIG. 18A the scissor mechanism for the leg rest is shown in a retracted mode. In FIG. 18B the scissor mechanism is shown in an expanded mode.

FIG. 19A illustrates the ankle gripper as it is moved vertically upward. FIG. 19B shows the ankle gripper as it is moved away from the lower portion of the seat.

FIGS. 20A and 20B are side view drawings showing the work surface. In FIG. 20A the worksurface is shown in its horizontal baseline position. In FIG. 20B the work surface is shown titled upward.

FIG. 21A shows the front of the workstation in its lowered position upon its base. FIG. 21B shows the front of the workstation raised with respect to its base.

FIGS. 22A and 22B are side view drawings showing the movement of the seat and back. In FIG. 22A the seat is slid fully back and the backrest for the seat is essentially in a vertical position. In FIG. 22B the seat is slid partly forward and the backrest for the seat is in a reclining position.

FIGS. 23A and 23B are side view drawings showing the detail of the manual adjustment scissors mechanism for horizontally moving the work surface. FIG. 23A shows the mechanism in a retracted mode when the work surface is drawn away from the user. FIG. 23B shows the mechanism in an expanded mode when the work surface is drawn toward the user.

FIGS. 24A and 24B are side view drawings showing the detail of the manual adjustment mechanism for vertically moving the work surface. FIG. 24A shows the work surface in a position lowered towards the user. FIG. 24B shows the work surface raised from the user.

FIG. 25A shows the work surface in its baseline position. FIG. 25B shows the work surface rotated to the left with respect to a user. FIG. 25C shows the work surface rotated to the right with respect to a user.

DETAILED DESCRIPTION OF THE INVENTION

Definitions

Figure 1:
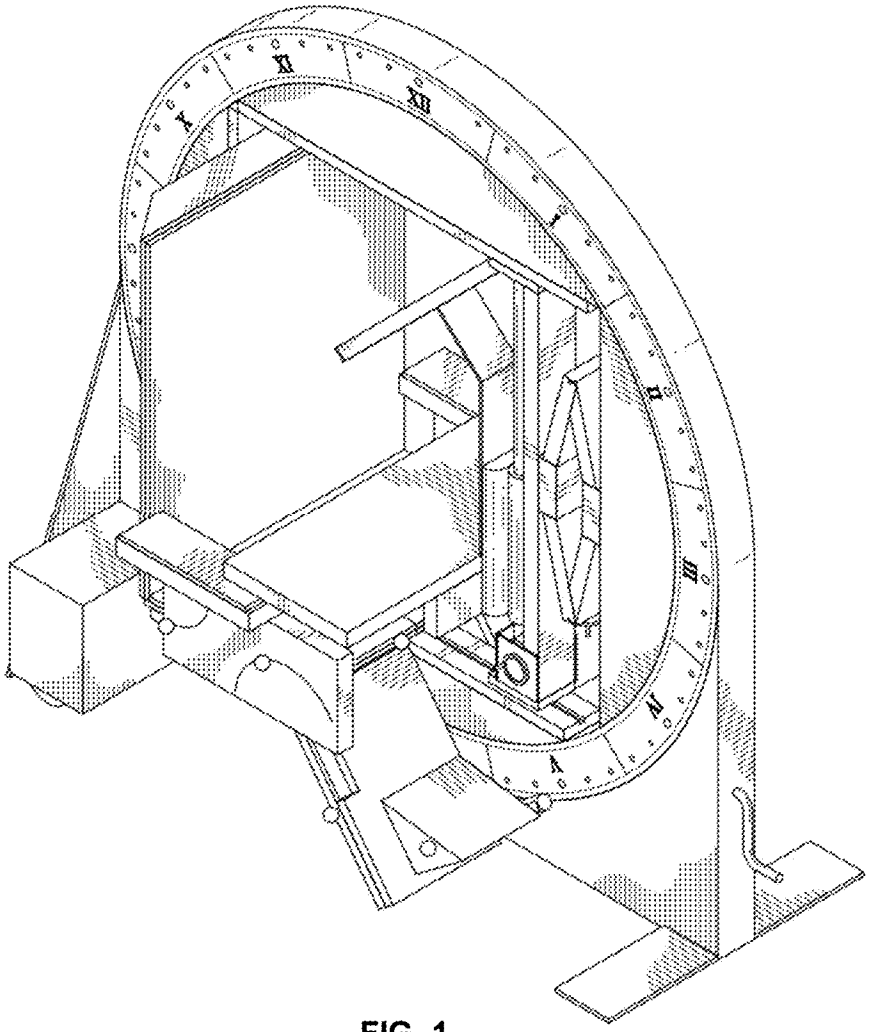
FIG. 1 is a perspective view of the ergonomic multi-positionable workstation of the present invention.
Figure 2:
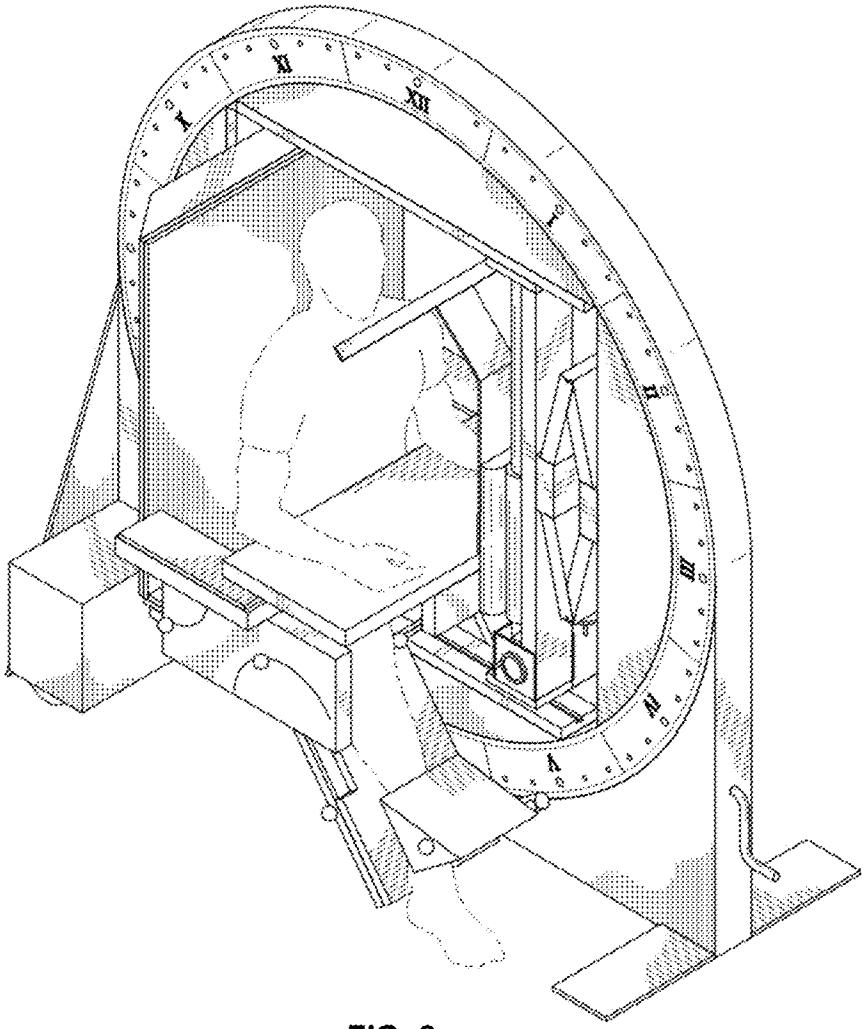
FIG. 2 is the same perspective view as FIG. 1 showing a human user, in phantom, seated within the workstation.
Figure 4:
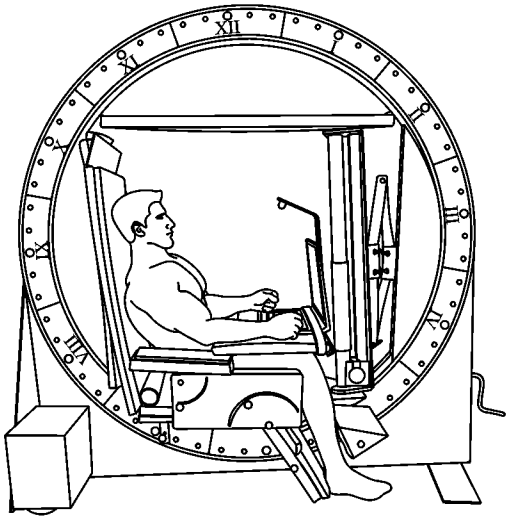
FIG. 4 is a photograph showing a side view of a 1:12 scale model (one inch to one foot) of the workstation oriented in the regular/conventional, i.e. baseline position where the seat and work surface are essentially horizontal in the regular sitting position (Position 1), shown with a mannequin positioned within the workstation.
Figure 5:
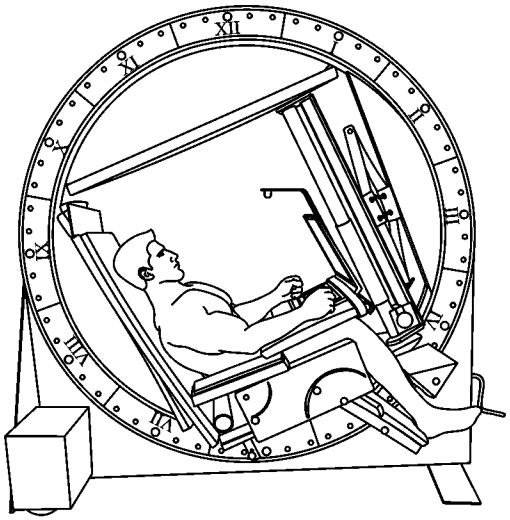
FIG. 5 is a photograph showing a side view of a 1:12 scale model (one inch to one foot) of the workstation oriented in the relaxed/reclined position (Position 2), shown with a mannequin positioned within the workstation.
Figure 6:
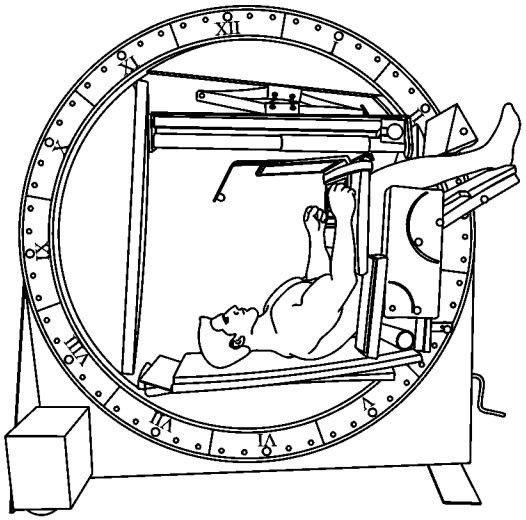
FIG. 6 is a photograph showing a side view of a 1:12 scale model (one inch to one foot) of the workstation oriented in the astronaut position (Position 3), shown with a mannequin positioned within the workstation.
Figure 7:
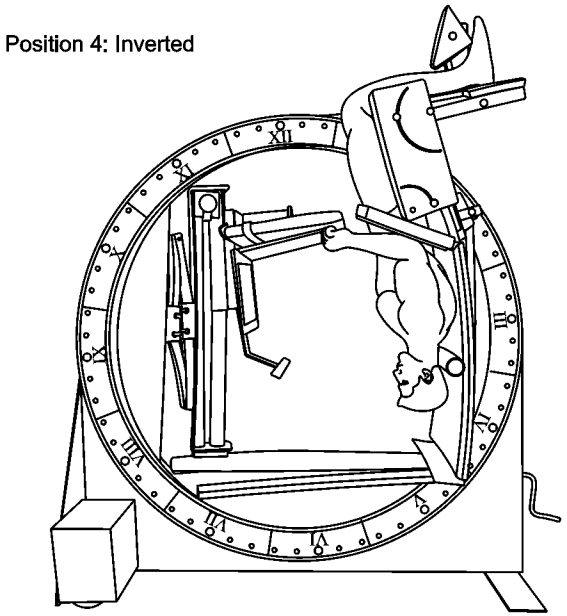
FIG. 7 is a photograph showing a side view of a 1:12 scale model (one inch to one foot) of the workstation oriented in the inverted position (Position 4), shown with a mannequin positioned within the workstation.
Figure 8:
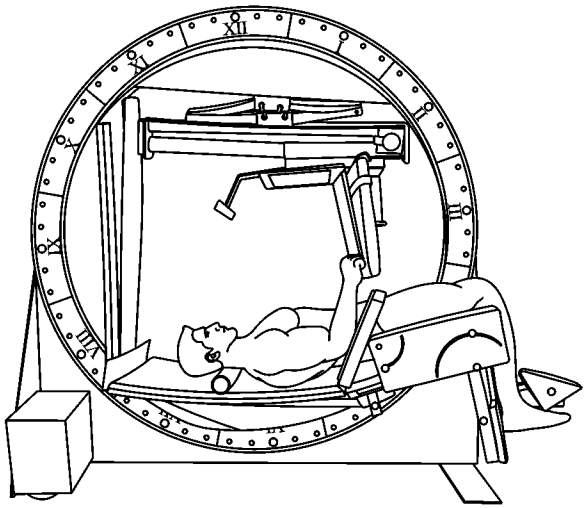
FIG. 8 is a photograph showing a side view of a 1:12 scale model (one inch to one foot) of the workstation oriented in the supine/lying down position (Position 5), shown with a mannequin positioned within the workstation.
Figure 9:
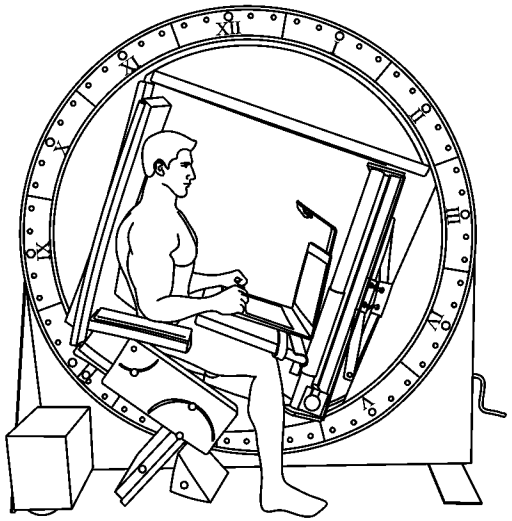
FIG. 9 is a photograph showing a side view of a 1:12 scale model (one inch to one foot) of the workstation oriented in the perched/leaning position (Position 6), shown with a mannequin positioned within the workstation.
Figure 10:
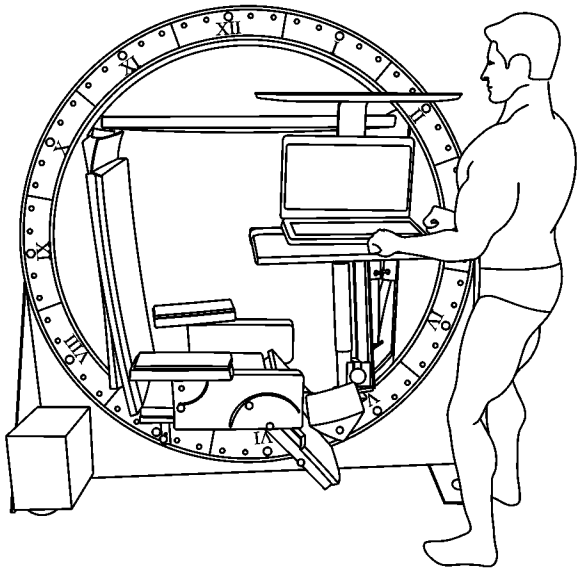
FIG. 10 is a photograph showing a side view of a 1:12 scale model (one inch to one foot) of the workstation oriented in the regular/conventional, i.e. baseline position where the seat and work surface are essentially horizontal, and where the work surface is swiveled outward to permit access by a user standing outside the workstation. This is referred to as the standing position (Position 7). Also, shown is a mannequin standing and positioned outside the workstation accessing the work surface.
Figures 11, 11A, 11B, 11C:
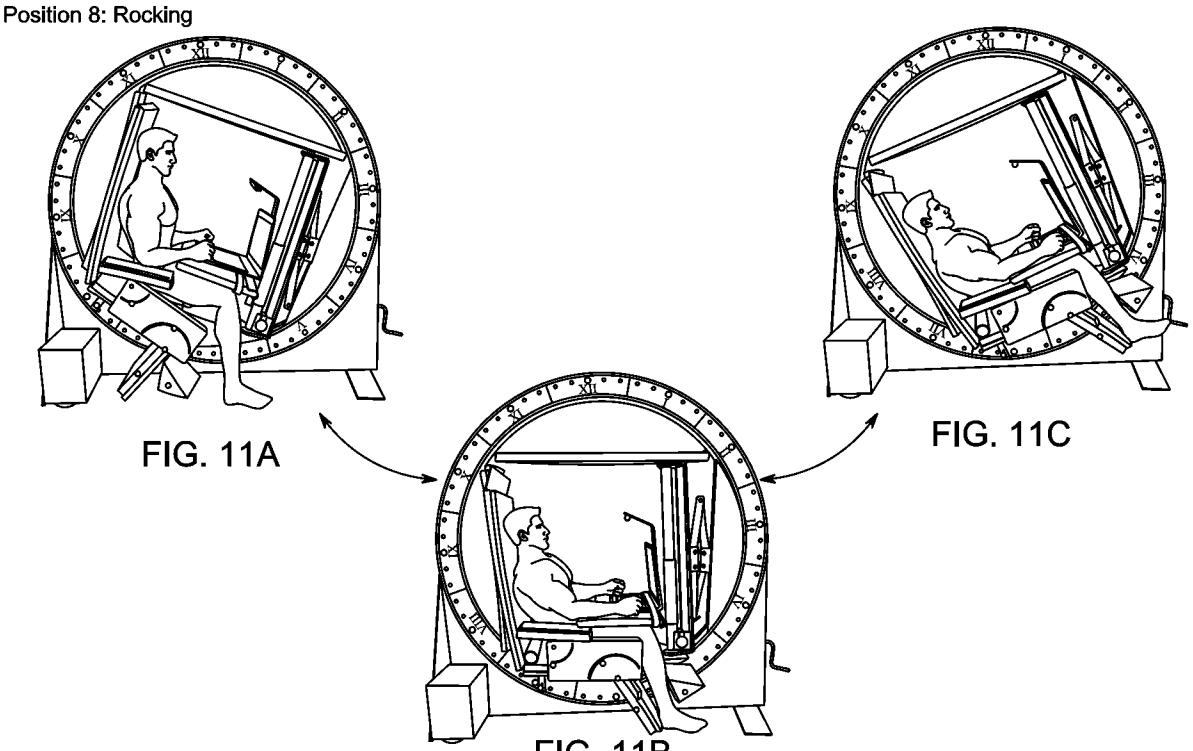
FIGS. 11A, 11B, and 11C are photographs showing side views of a 1:12 scale model (one inch to one foot) of the workstation being used in the rocking chair mode with a mannequin positioned within the workstation. This mode is referred to as the rocking position (Position 8). In the rocking chair mode the workstation is rocked in a continuous and period motion through the regular/conventional, i.e. baseline position (FIG. 11B) to the reclined/relaxed position (FIG. 11C) and to the perched/leaning position (FIG. 11A).
Figure 12:
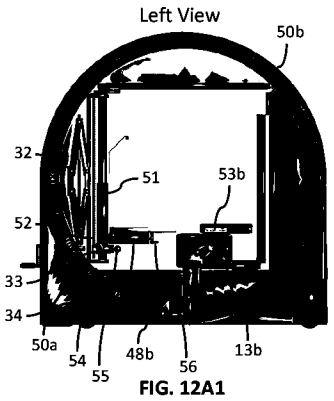
Figure 12:
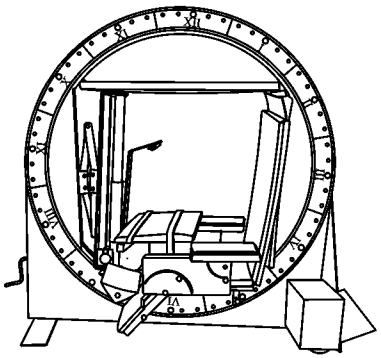
Figure 12:
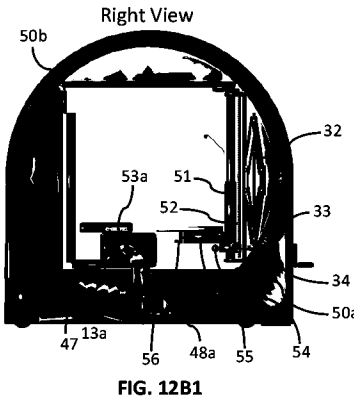
Figure 12:
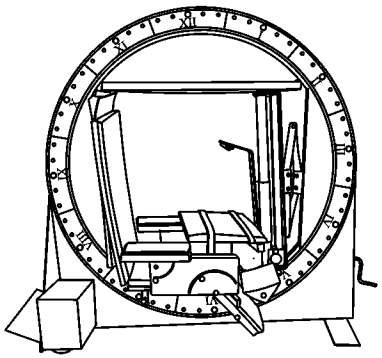
Figure 13:
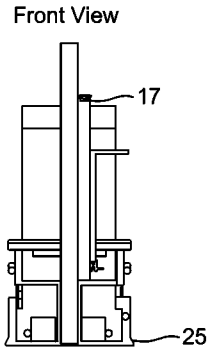
Figure 13:
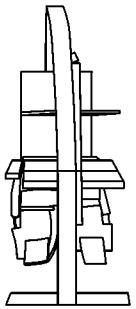
Figure 13:
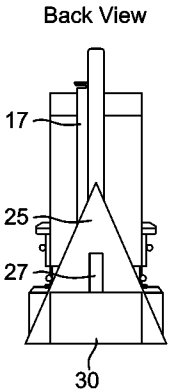
Figure 13:
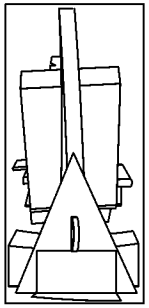
Figure 14:
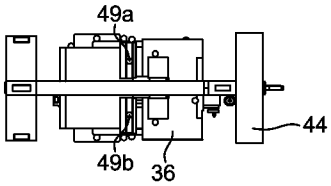
Figure 14:
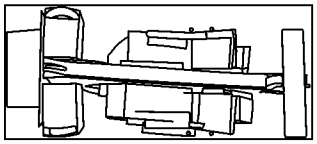
Figure 14:
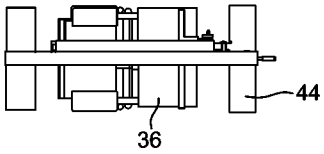
Figure 14:
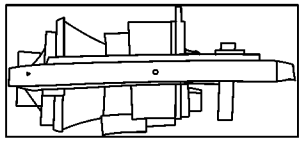
Figure 15:
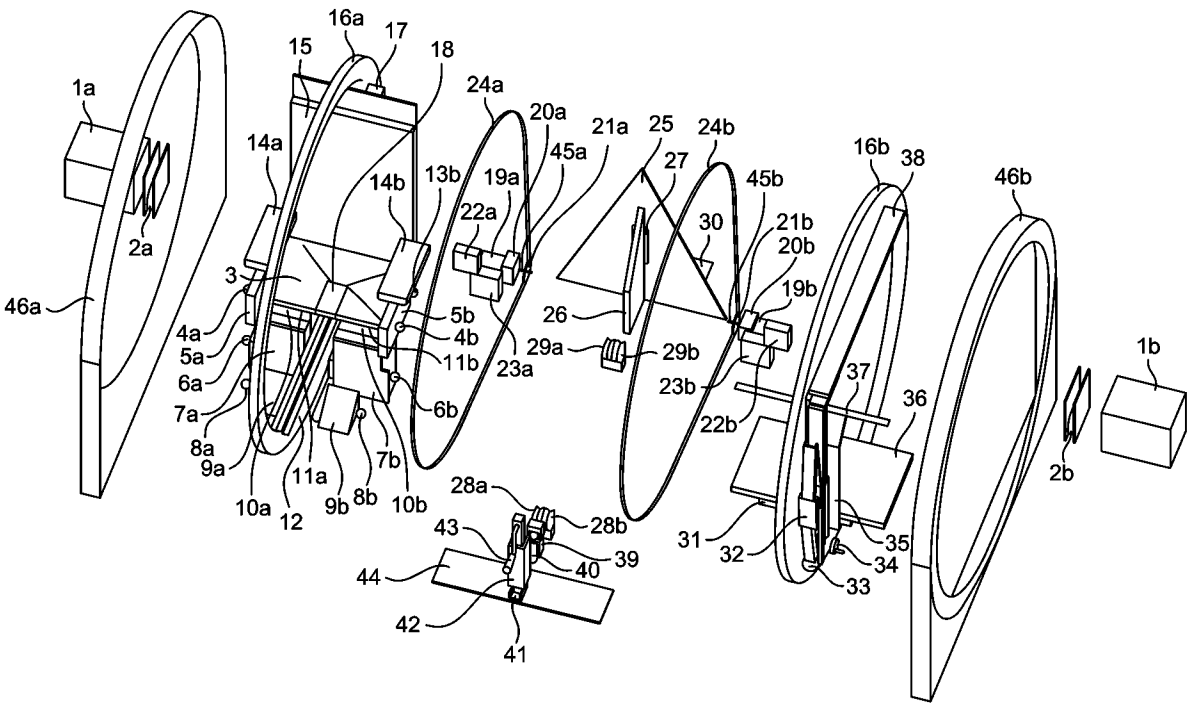
FIG. 15 is an exploded perspective view showing the components of the workstation.
Figure 16:
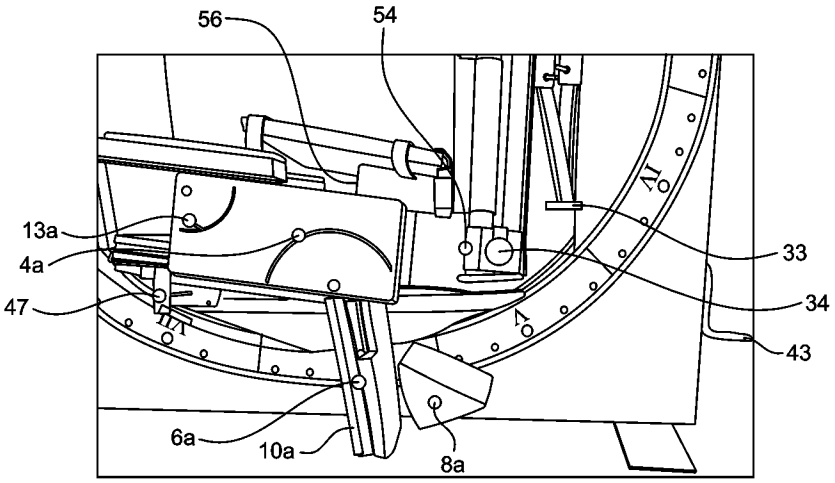
FIG. 16 is a close-up photograph of a partial planar view of a 1:12 scale model (one inch to one foot) of the workstation indicating various manual adjustment mechanism details.
Figures 19, 19A, 19B:
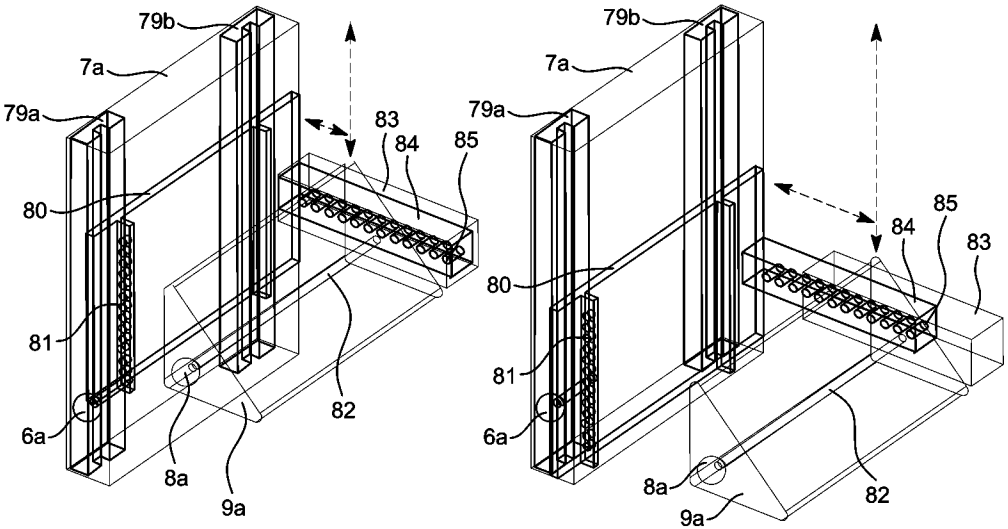
FIGS. 19A and 19B are perspective drawings showing the ankle gripper (retainer) feature.
Figures 21, 21A, 21B:
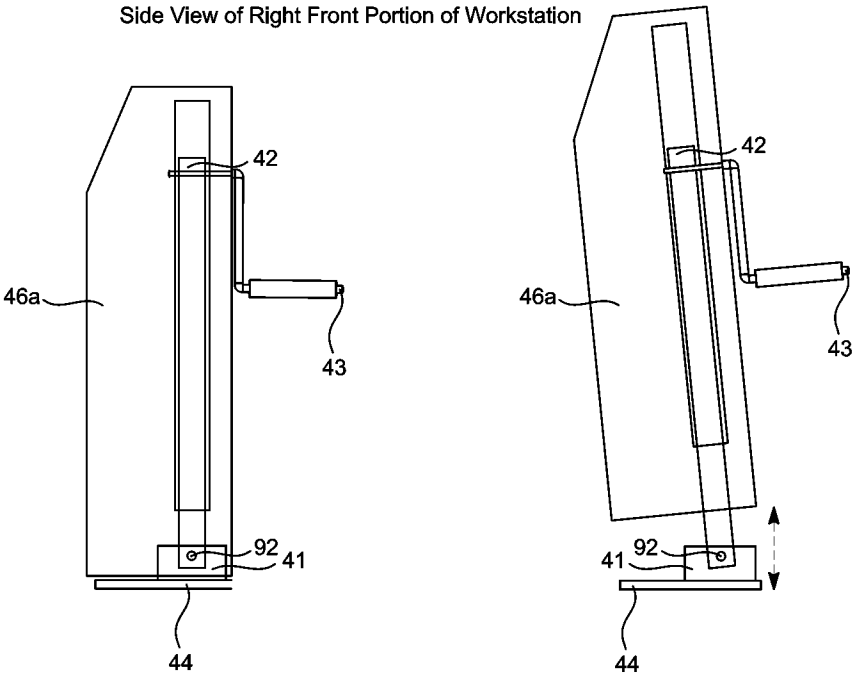
FIGS. 21A and 21B are side view drawings of the front portion of the right side (the right side is defined as the side corresponding to the right side of a user positioned in the workstation) of the workstation. The drawings show a manual crank mechanism for raising and lowering the workstation with respect to its base.
Figures 25, 25A, 25B, 25C:
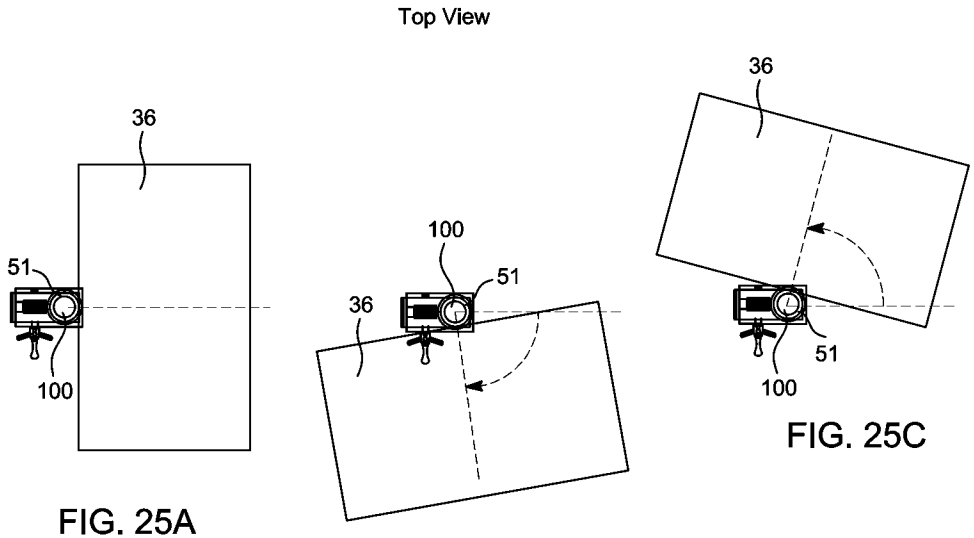
FIGS. 25A, 25B, and 25C are top view drawings of the work surface showing its horizontal rotational features.

As used herein, the following terms and abbreviations have the indicated meanings unless expressly stated to the contrary.

The term "ergonomic" is used herein to have its common meaning indicating relating to or designed for efficiency and comfort in the working environment.

The terms "multi-positionable" and "multi-positional" as used herein mean that the workstation can be oriented and used in different positions, and that the components such as the chair and work areas can be oriented and positioned by a user as desired, and preferably where the chair and work areas can be independently positioned with respect to each other.

The term "subject" means a human user or consumer of the workstation of the present invention.

Ergonomic Multi-Positionable Workstation

The present invention provides an ergonomic multi-positionable (also multi-positional) workstation having independently positionable and adjustable seating and work area components. The seating components can further comprise back, leg support, and head support components, and the work area components can further comprise a work surface or desk area and areas for accommodating a computer keyboard and monitor. The workstation can provide at least eight distinct positions and a continuum of positions in between.

As described above, many available workstations are limited in the range of adjustments and positions that can be achieved.

To address these limitations, the present invention teaches an ergonomic multi-positional workstation that enables not only (1) sitting position, (2) leaning back position, and (3) reclining (to full supine) position, but also (4) "perched" (leaning forward) position (5) "astronaut" position (wherein legs are elevated and back rests solidly parallel to floor, as with astronauts in launch position), (6) "inverted" (upside down) position (including both partial and full inversion, whereby the person hangs in a fully vertical upside down position, perpendicular to the floor), (7) "standing workstation" position, and (8) automated rocking chair motion or functionality. As well, the invention enables a continuum of variation to each of these positions. In addition, numerous manual adjustment mechanisms are provided to enable the largest population of users to achieve optimal fit and comfort in positioning their legs, feet, buttocks, torso, arms, hands, and head.

This large range of adjustability is achieved by means of two independently operational rotating rings for the chair and work areas. In other words, one ring is attached to and provides positioning for the chair and other ring is attached to and provides positioning for the work area and computer monitor. The work area is designed to accommodate a desk or writing surface and area for a keyboard.

Each of the support rings are continuously rotatable over their entire 360 degree rotation range in either direction, provided that the chair and work area and/or monitor do not physically interfere. In some embodiments, one or more fixed or adjustable position sensors or stops may be employed to halt motor motion before such interference occurs or, alternatively or additionally, one or both motors may be encoded to provide position readout to one or more computer controllers in order to prevent interference. The rotation of each ring may be defined by an axis perpendicular the planes defined by the circumference of each ring. The axis is an imaginary axis and is not a physical part of the workstation, but instead a mental construct that further defines the shape, function, and movement of the support rings.

Figure 26:
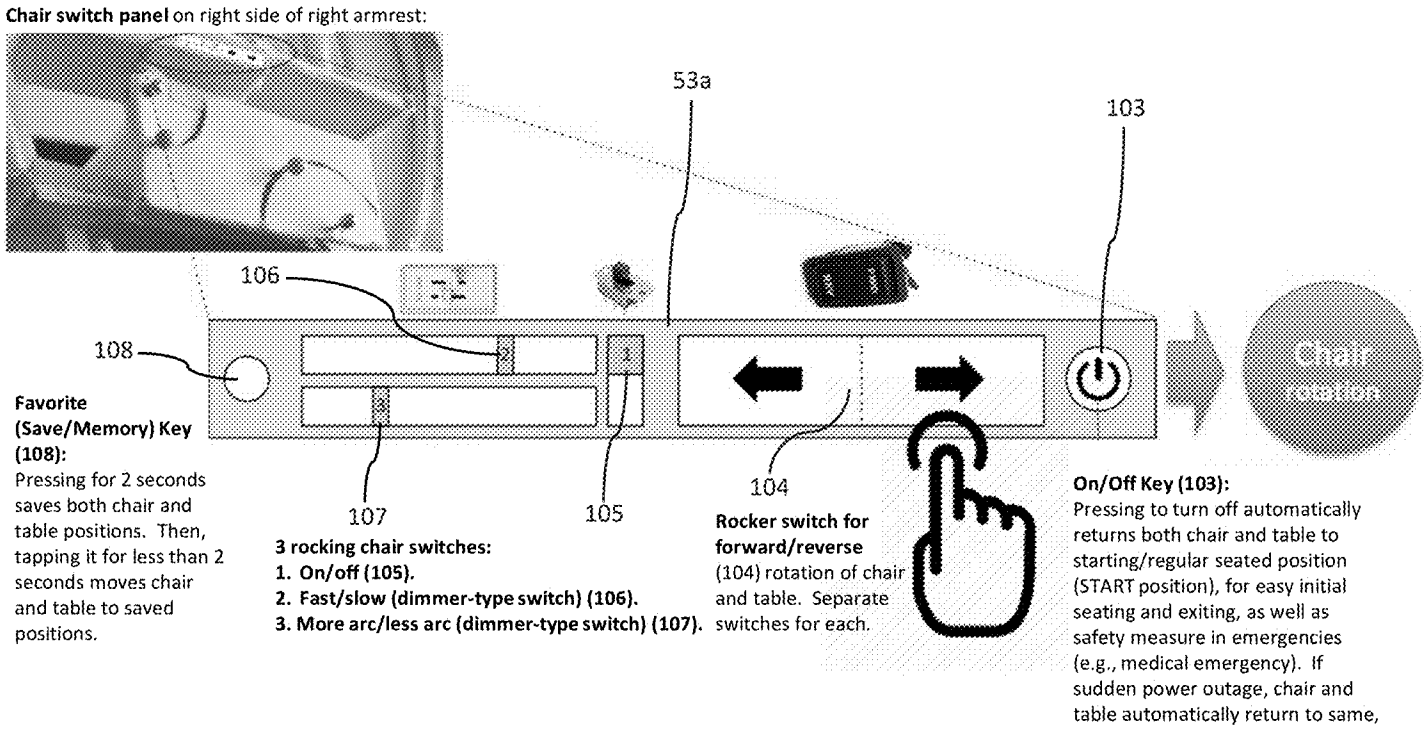
FIG. 26 is a drawing of an embodiment of a user control panel that can be located on the arm rests for independently controlling the chair and work area. The drawing illustrates the features shown in the perspective photo of the control panel.

In some embodiments, the multi-positionable aspect of the present invention is achieved using a chain and sprocket mechanism connected to two independently operational gearbox electric motors having brakes and fans and computer controllers, the user achieves independent rotational movement forward and backwards of chair and table. The user controls the two independent rings to which chair and work surface (i.e. also known as the table) are attached by means of two control panels located on the right and left armrests of the chair (see FIG. 26). These two control panels also enable on/off control and speed and range of motion (degree of arc) of the automated rocking motion of the chair and table. On the control panel too, a memory key is provided to enable the user to save chair and work surface positions for future use (hold key for 2 seconds to save positions, tap key for less than 2 seconds to return chair and work surface to saved positions). A workstation on/off power button is provided on the same control panel, and, as a convenience and safety measure, whenever the power is turned off, either by the user pressing the on/off button or due to a power outage or other cause, the invention automatically returns to the starting (i.e., regular seated) position, so that the user can easily and safely exit or, upon exiting, re-enter (be seated in) the device. Moreover, the invention, having (1) mounting brackets (e.g., for multiple monitors, keyboards, mouse pads, joysticks), (2) electrical panels with standard computer ports (e.g., USB, HDMI) and power outlets, (3) conduit for concealing unsightly wiring, and (4) rear-mounted retractable supporting platform for carrying a desktop workstation, provides for ready and attractive use with a plethora of computing, smartphone, and television devices and peripherals, as well as even non-computing devices (e.g., bookstands, easels, cup holders) mounted to the table. An overhead lamp provides illumination for the user. Finally, the invention's form factor and wheels enable it to be effortlessly transported across and between residential and office rooms, through standard doorways and hallways, and on elevators or lifts.

The following Table 1 is a compilation of the components of the ergonomic, multipositionable workstation of the present invention with the assigned reference numbers. The table includes the following information: the reference number assigned to the component, a description of the component, and the figure number, or sub number where applicable, where the component is depicted. It should be noted that some of the components are shown in more than one figure, and that the reference number is not used to call out each occurrence of the component in every figure.

TABLE 1

Compilation of the Components of the Ergonomic Multi-positionable Workstation

| Ref. No. | FIG. No. | Description |
|---|---|---|
| 1a | 15 | Housing for seat drive mechanism (e.g., electric motor with brake and gearbox), cooling fan, and computer controller, as well as rear right fixed wheel 2a. |
| 1b | 15 | Housing for work surface drive mechanism (e.g., electric motor with brake and gearbox), cooling fan, and computer controller, as well as rear left fixed wheel 2b. |
| 2a | 15 | Rear right fixed wheel, to enable workstation mobility. |
| 2b | 15 | Rear left fixed wheel, to enable workstation mobility. |
| 3 | 15, 17, 22 | Adjustable seat |
| 4a | 15, 17 | User pin (e.g., spring-loaded plunger pin) with handle to adjust right leg angle. |
| 4b | 15 | User pin (e.g., spring-loaded plunger pin) with handle to adjust left leg angle. |
| 5a | 15, 17 | Support and adjustment mechanism for right leg angle and right armrest. |
| 5b | 15 | Support and adjustment mechanism for left leg angle and left armrest. |
| 6a | 15, 19 | User pin (e.g., spring-loaded plunger pin) to adjust right ankle cushion clamp along foot-knee axis. |
| 6b | 15 | User pin (e.g., spring-loaded plunger pin) to adjust left ankle cushion clamp along foot-knee axis. |
| 7a | 15, 19 | Support for right leg, as well as adjustment mechanism for ankle cushion clamp along foot-knee axis. |
| 7b | 15 | Support for left leg, as well as adjustment mechanism for ankle cushion clamp along foot-knee axis. |
| 8a | 15, 19 | User pin (e.g., spring-loaded plunger pin) for clamping down or releasing grip of cushion on right ankle. |
| 8b | 15 | User pin (e.g., spring-loaded plunger pin) for clamping down or releasing grip of cushion on left ankle. |
| 9a | 15, 19 | Freely rotating cushion for (1) clamping and supporting right ankle during chair rotation or (2) resting right foot. |
| 9b | 15 | Freely rotating cushion for (1) clamping and supporting left ankle during chair rotation or (2) resting left foot. |
| 10a | 15, 17, 18 | Adjustment mechanism to accommodate right thigh (femoral) length: length increases or decreases as user rotates dial 11a. Alternatively, thigh adjustment mechanism 10a may be positioned 90 degrees on its side, so that user dial 11a is positioned on right side rather than on top as shown. |
| 10b | 15 | Adjustment mechanism to accommodate left thigh length: length increases or decreases as user rotates dial 11b. Alternatively, thigh adjustment mechanism 10b may be positioned 90 degrees on its side, so that user dial 11b is positioned on left side rather than on top. |
| 11a | 15, 18 | User dial to adjust (increase or decrease) right thigh (femoral) length, for proper anthropometric fit. |
| 11b | 15 | User dial to adjust (increase or decrease) left thigh (femoral) length, for proper anthropometric fit. |
| 12 | 15, 22 | Linear bearing guide attached to chair, supporting it, and enabling its forward-backward movement. |
| 13a | 12, 17 | User pin (e.g., spring-loaded plunger pin) to adjust angle of right armrest. |
| 13b | 12, 15 | User pin (e.g., spring-loaded plunger pin) to adjust angle of left armrest. |
| 14a | 15, 17 | Right armrest. |
| 14b | 15 | Left armrest. |
| 15 | 15, 22 | Seat backrest |
| 16a | 15, 22 | First rotatable support ring - for chair. |
| 16b | 15 | Second rotatable support ring - for table. |
| 17 | 13, 15 | Linear bearing guide attached to backrest, supporting it, and enabling its upward and downward movement, and contributing to its angle. |
| 18 | 15 | Hinged center seat part: hinge enables it to rise when pressed against front rings as backrest is laid down to full horizontal position (planar with seat) during setup for supine and inverted human body positions. |
| 19a | 15 | Electric motor with brake for rotating chair. Electric motor may be of any type (e.g., DC, AC, brushed, brushless, stepper motor, servomotor), and may be powered by plugging into standard wall outlets or, alternatively, by any type of battery (e.g., rechargeable lithium ion). |
| 19b | 15 | Electric motor with brake for rotating table. Electric motor may be of any type (e.g., DC, AC, brushed, brushless, |

TABLE 1-continued

Compilation of the Components of the Ergonomic Multi-positionable Workstation

| Ref. No. | FIG. No. | Description |
|---|---|---|
| | | stepper motor, servomotor), and may be powered by plugging into standard wall outlets or, alternatively, by any type of battery (e.g., rechargeable lithium ion). |
| 20a | 15 | Gearbox connected to electric motor for rotating chair. |
| 20b | 15 | Gearbox connected to electric motor for rotating table. |
| 21a | 15 | Sprocket connected to shaft of electric motor, for rotating chair. |
| 21b | 15 | Sprocket connected to shaft of electric motor, for rotating table. |
| 22a | 15 | Computer controller for chair. Computer controller (e.g., Raspberry Pi, Arduino) is capable of connection to and control of a plethora of peripheral devices, including electric motor and user control panel 53a and 53b, speech recognition devices, speech synthesizers, audio (including speech) recording input or output devices, fingerprint scanners, palm vein scanners, retinal scanners, video monitors of all kinds, printers/scanners, communications connections of all kinds (e.g., Ethernet, Bluetooth, USB), keyboards, mice, trackballs, etc. For example, a fingerprint or palm scanner may be connected to computer controller 22a to prevent small children (for their safety) or unauthorized people from using the invention. By connection to auditory or video peripherals, the computer controller 22a may be configured to voice or sound alarms, or display visual alerts, notices, instruction, or guidance. By means of the communication channels that interface with the computer, networking of the invention may also be enabled to monitor and control usage of the invention over the internet or cloud. |
| 22b | 15 | Computer controller for table. Computer controller (e.g., Raspberry Pi, Arduino) is capable of connection to and control of a plethora of peripheral devices, including electric motor and user control panel 53a and 53b, speech recognition devices, speech synthesizers, audio (including speech) recording input or output devices, fingerprint scanners, palm vein scanners, retinal scanners, video monitors of all kinds, printers/scanners, communications connections of all kinds (e.g., Ethernet, Bluetooth, USB), keyboards, mice, trackballs, etc. For example, a fingerprint or palm scanner may be connected to computer controller 22b to prevent small children (for their safety) or unauthorized people from using the invention. By connection to auditory or video peripherals, the computer controller 22b may be configured to voice or sound alarms, or display visual alerts, notices, instruction, or guidance. By means of the communication channels that interface with the computer, networking of the invention may also be enabled to monitor and control usage of the invention over the internet or cloud. |
| 23a | 15 | Fan to cool chair's electric motor. |
| 23b | 15 | Fan to cool table's electric motor. |
| 24a | 15 | Chain connected to chair ring and sprocket and electric motor, to rotate chair. |
| 24b | 15 | Chain connected to chair ring and sprocket and electric motor, to rotate table. |
| 25 | 13, 15 | Triangular base element in back, attached to stationary frames (46a, 46b). |
| 26 | 15 | Housing for wiring connecting electrical panels 31 to 27, wiring carried by rings 16a and 16b. |
| 27 | 13, 15 | Rear electrical panel with power outlets, USB, Ethernet, video, audio, and other standard ports. |
| 28a | 15 | V-groove roller to support front of chair ring 16a. |
| 28b | 15 | V-groove roller to support front of work surface ring 16b. |
| 29a | 15 | V-groove roller to support back of chair ring 16a. |
| 29b | 15 | V-groove roller to support back of work surface ring 16b. |
| 30 | 13, 15 | Hinged base support that, when retracted, supports the user's (optional) desktop computer or other equipment in rear. |
| 31 | 15, 20 | Front (under table) electrical panel with power outlets, USB, Ethernet, video, audio, and other standard ports. |
| 32 | 12, 15, 23 | Scissors lift/jack (e.g., adapted motorcycle scissors lift/jack, RV-type lift/jack) to move work surface toward or away from user - horizontally, for comfortable fit, attached to table support ring 16b. Any other type of scissors lift/jack may be used, e.g., hydraulic, electric/diesel, or pneumatic. The scissors lift/jack may also have its arms |

TABLE 1-continued

Compilation of the Components of the Ergonomic Multi-positionable Workstation

| Ref. No. | FIG. No. | Description |
|---|---|---|
| | | arranged in a diamond-type fashion (as shown in the figures) or in an "X" type arrangement, i.e., having crossing support arms in an "X"-type fashion (e.g., adapted motorcycle scissors jack, RV-type jack). |
| 33 | 12, 15, 23 | User dial/disc wheel that controls horizontal work surface movement (closer and farther from user). |
| 34 | 12, 15, 24 | User dial/disc wheel that controls vertical work surface movement (up and down elevation). |
| 35 | 15 | Support for monitor. |
| 36 | 14, 15, 20, 24, 25 | Support for work surface, keyboard, or both (i.e., "table"). |
| 37 | 15 | Lamp to provide lighting on table. Lamp may be adjusted vertically for closer or farther distance from work surface ("table") 36. |
| 38 | 15 | Linear bearing guide to provide support for work surface and monitor, as well as a track for their horizontal movement closer to or farther from user. |
| 39 | 15 | Swivel support mechanism for front wheel of workstation, enabling easy turning of front wheel as workstation is transported. |
| 40 | 15 | Front swivel wheel of workstation, enabling easy transport of workstation, in concert with the two back fixed wheels 2a and 2b. |
| 41 | 15, 21 | Articulating base of trailer-type jack, so that base 44 remains in full contact with floor as jack raises or lowers entire front of workstation. By "trailer-type jack" is meant a jack that can be similar to one used with a trailer that is hitched to a towing vehicle when it is in a stationary mode. |
| 42 | 15, 21 | Trailer-type jack, for lifting and lowering entire front of workstation. |
| 43 | 15, 21 | User crank handle for trailer-type jack, that, when cranked, lifts or lowers entire front of workstation, to accommodate very tall users or to achieve floor clearance when initiating rocking motion. |
| 44 | 14, 15, 21 | Rectangular base element in front, attached via 41 and 42 to stationary frames 46a and 46b. |
| 45a | 15 | Axle of electric motor connected to sprocket, for chair ring. |
| 45b | 15 | Axle of electric motor connected to sprocket, for work surface ring. |
| 46a | 15, 21 | Stationary frame - right side. |
| 46b | 15 | Stationary frame - left side. |
| 47 | 12, 22 | User pin (e.g., spring-loaded plunger pin) to adjust seat horizontally forward and backward along linear guide. |
| 48a | 12 | Sensor to avoid chair collision with floor (right side). Alternatively, may also be a simple spring-loaded push button switch, which, when contact is made that presses the switch, turns off electric motors and sounds alarm. |
| 48b | 12 | Sensor to avoid chair collision with floor (left side). Alternatively, may also be a simple spring-loaded push button switch, which, when contact is made that presses the switch, turns off electric motors and sounds alarm. |
| 49a | 14 | Sensor to avoid chair collision with floor (right side). Alternatively, may also be a simple spring-loaded push button switch, which, when contact is made that presses the switch, turns off electric motors and sounds alarm. |
| 49b | 14 | Sensor to avoid chair collision with floor (left side). Alternatively, may also be a simple spring-loaded push button switch, which, when contact is made that presses the switch, turns off electric motors and sounds alarm. |
| 50a | 12 | Sensor to avoid chair-table collision (bottom). Alternatively, may also be a simple spring-loaded push button switch, which, when contact is made that presses the switch, turns off electric motors and sounds alarm. |
| 50b | 12 | Sensor to avoid chair-table collision (top). Alternatively, may also be a simple spring-loaded push button switch, which, when contact is made that presses the switch, turns off electric motors and sounds alarm. |
| 51 | 12, 24, 25 | Moving column attached to work surface and monitor support, enabling their rotation left and right for easy user seating and exiting from seat, as well as vertical movement of table. |
| 52 | 12 | Drive mechanism (e.g., rack and pinion) to raise and lower the work surface for the user - vertically. |
| 53a | 12, 26 | User control panel to (1) turn on and off power, (2) advance forward and backward rotation of chair, (3) increase or decrease speed of rocking motion, (4) increase |

TABLE 1-continued

Compilation of the Components of the Ergonomic Multi-positionable Workstation

| Ref. No. | FIG. No. | Description |
|---|---|---|
| | | or decrease degree of arc of rocking motion of chair, (5) save in memory a preferred chair and work surface position, and (6) recall from memory a saved (preferred) chair and work surface position. |
| 53b | 12 | User control panel to (1) turn on and off power, (2) advance forward and backward rotation of table, (3) increase or decrease speed of rocking motion of table, (4) increase or decrease degree of arc of rocking motion, (5) save in memory a preferred chair and work surface position, and (6) recall from memory a saved (preferred) chair and work surface position. |
| 54 | 12, 24 | User pin (e.g., standard plunger pin) to adjust and fix in place right- and left-turning column 51, attached to work surface and monitor support. |
| 55 | 12 | Adjustment mechanism to raise and lower angle of work surface itself, by rotating dial 56. |
| 56 | 12, 20 | User dial/disc wheel that raises angle of work surface to achieve comfortable work surface angles even when work surface ring assembly 16b rotates forward. |
| 68 | 17 | Hinge connecting armrest to support for armrest. |
| 69 | 17 | Pivot arm for rotating armrest, connected to arm rest and support for armrest. |
| 70 | 17 | Index holes, into which plunger pins are inserted, for selecting angle of armrest. |
| 71 | 17 | External slot for sliding spring loaded plunger pin, to select angle of armrest. |
| 72 | 17 | External slot for sliding spring loaded plunger pin, to select angle of leg rest. |
| 73 | 17 | Index holes, into which plunger pins are inserted, for selecting angle of leg rest. |
| 74 | 17 | Hinge connecting leg rest to support for leg rest (under seat 3). |
| 75a | 18 | Base (fixed) of adjustment mechanism to accommodate right thigh (femoral) length. |
| 75b | 18 | Top (moving) of adjustment mechanism to accommodate right thigh (femoral) length. |
| 76 | 18 | Screw that, when turned by subject, expands/contracts thigh (femoral) length of adjustment mechanism. |
| 77 | 18 | Nut, through which screw 76 passes, attached to scissors lift 78 of thigh adjustment mechanism. |
| 78 | 18 | Scissors lift of thigh (femoral) adjustment mechanism. |
| 79a | 19 | Right linear guide rail with sliding block, to guide and support internal carrier of ankle cushion/rest attached to it. |
| 79b | 19 | Left linear guide rail with sliding block, to guide and support internal carrier of ankle cushion/rest attached to it. |
| 80 | 19 | Internal carrier (sled) of ankle cushion/footrest. |
| 81 | 19 | Index holes of internal carrier of ankle cushion/rest 80. |
| 82 | 19 | Cylinder tube, serving two functions: (1) containment of spring-loaded plunger pin 8a and (2) axle support for freely rotating cushion of ankle support/footrest 9a. |
| 83 | 19 | Outer square tubing that slides up and down to grip ankle or for comfortable footrest support. |
| 84 | 19 | Inner square tubing that is fixed and attached to internal carrier of ankle cushion/rest 80 and guides sliding of outer square tubing 83 that slides grip ankle/footrest. |
| 85 | 19 | Index holes, through which plunger pin passes to select position of freely rotating ankle/foot cushion 9a. |
| 86 | 20 | Nut for threaded bolt (screw) 87, attached to axle 88 and arm 89 to raise and lower work surface 36. |
| 87 | 20 | Threaded bolt attached to user disk wheel 56 and nut 86, enabling raising and lowering work surface support 36. |
| 88 | 20 | Axle (pivot point) to enable raising and lowering work surface arm 89. |
| 89 | 20 | Table arm for raising and lowering work surface 36. |
| 90 | 20 | Axle connecting work surface arm 89 to work surface support 36. |
| 91 | 20 | Piano hinge to enable adjustment of arc of work surface (work support) 36. |
| 92 | 21 | Axle (pivot point) of articulating base 41, connecting trailer-type lift 42 to front base 44. |
| 93 | 22 | Support for spring-loaded plunger pin 47 that enables subject to set position of seat forward and backward. Connected to seat 3. |
| 94 | 22 | Index holes in chair ring 16a, through which spring-loaded plunger pin 47 passes to set position of seat forward and backward. |

TABLE 1-continued

Compilation of the Components of the Ergonomic Multi-positionable Workstation

| Ref. No. | FIG. No. | Description |
|---|---|---|
| 95 | 23 | Screw of scissors lift 32, attached to user dial/disc wheel 33 that when rotated by subject controls horizontal work surface movement. |
| 96 | 23 | Brace of adjustment mechanism for raising and lowering table, detailed in FIG. 24. |
| 97 | 24 | Rack, of rack and pinion mechanism for adjusting vertical height of work surface 36. |
| 98 | 24 | Pinion, of rack and pinion mechanism for adjusting vertical height of work surface 36. |
| 99a | 24 | Top support connecting rack and pinion mechanism to columns and table. |
| 99b | 24 | Bottom support connecting rack and pinion mechanism to columns and table. |
| 100 | 24, 25 | Inner (fixed) column (cylindrical tube) over which outer column (cylindrical tube) 51 passes. |
| 101 | 24 | Housing with two purposes: (1) to join rack and pinion and (2) to lock outer column/tubing in fixed position (middle/left/right work surface movement). |
| 102 | 24 | Index holes circling outer tubing, which, when subject inserts user pin 54, fixes work surface 36 in middle/left/right position. |
| 103 | 26 | Power on/off key of user control panel. |
| 104 | 26 | Rocker switch to rotate ring forward or reverse. |
| 105 | 26 | On/off switch for rocking motion of rings. |
| 106 | 26 | Fast/slow dimmer-type switch for speed of rocking motion of rings. |
| 107 | 26 | Dimmer-type switch to increase/decrease arc of rocking motion. |
| 108 | 26 | Memory key to save (e.g., by pressing for 2 seconds) static position of two rings, and immediately reinstate previously saved position (e.g., by pressing for less than 2 seconds) same memory key. |

Drive Mechanism. Drive mechanism alternatives to the embodiment described above (electric gearbox motor with brake and chain and sprocket) include drum and belt or rack and pinion instead of chain and sprocket. Instead of an electric motor, a mechanical drive mechanism can be used, for example, a crank for hand or foot. The drive mechanism can be battery-operated rather than powered by standard electric power outlet in a preferred embodiment.

Adjustment Mechanisms. Note that in preferred embodiments of the workstation, all of the adjustment mechanisms—except for those mechanisms controlling the first and second rotatable support rings—are manually controlled, i.e. those adjustment mechanisms do not require an independently powered drive mechanism. However, in other embodiments, any or all of the manual adjustment mechanisms can instead be driven by an electric motor in the form of linear actuators, motorized ball screws, motorized chains and sprockets, motorized racks and pinions, or by hydraulic mechanisms, and any other such independently powered mechanisms. The tracks on which the seat moves forward and backward and the work surface moves toward and away from the user may also use mechanisms other than what is shown in the figures, i.e., conventional heavy-duty linear bearing slide rails; that could for example utilize heavy-duty drawer slides instead of linear bearing guides.

User Control Panel. A multitude of variation is possible for the user control panels. Different buttons, switches, and control mechanisms, different layout of those buttons, switches, and controls, and different placement of the control panels (other than on the two arm rests) are all equivalently covered.

Seat and Work Surface. A multitude of variation in type of seat and work surface is equivalently possible. The seat and work surface can be differing in size, shape, cushioning, materials, thickness, and other attributes, but equivalent in function and fit.

Frame and Base Elements. A multitude of frame (in a preferred embodiment having left and right sides that are joined together to enclose and secure the two internal rings and drive mechanism, among other elements) and base elements (in an embodiment are attached to front and back to keep the workstation stable and upright) are equivalently possible. For example, the frame can be constructed of top and bottom, rather than left and right, halves or pieces and then joined together. And the base elements can be of different shapes (e.g., semicircular rather than triangular in back), sizes, thicknesses, and materials, and may even be constructed of one united piece, constituting one solid base, rather than separate front and back pieces in the preferred embodiment.

INCORPORATION BY REFERENCE

The entire disclosure of each of the patent documents, including certificates of correction, patent application documents, scientific articles, governmental reports, websites, and other references referred to herein is incorporated by reference herein in its entirety for all purposes. In case of a conflict in terminology, the present specification controls.

EQUIVALENTS

The invention can be embodied in other specific forms without departing from the spirit or essential characteristics thereof. The foregoing embodiments are to be considered in all respects illustrative rather than limiting on the invention described herein. In the various embodiments of the present invention, where the term comprises is used with respect to the recited components or methods, it is also contemplated that the invention consists essentially of, or consists of, the recited components or methods. Furthermore, it should be understood that the order of steps or order for performing certain actions is immaterial so long as the invention remains operable. Moreover, two or more steps or actions can be conducted simultaneously.

In the specification, the singular forms also include the plural forms, unless the context clearly dictates otherwise. Unless defined otherwise, all technical and scientific terms used herein have the same meaning as commonly understood by one of ordinary skill in the art to which this invention belongs. In the case of conflict, the present specification will control.

Furthermore, it should be recognized that in certain instances an article of manufacture can be described as being composed of the components prior to assembly or incorporation into the article of manufacture.

All percentages and ratios used herein, unless otherwise indicated, are by weight. It is recognized the mass of an object is often referred to as its weight in everyday usage and for most common scientific purposes, but that mass technically refers to the amount of matter of an object, whereas weight refers to the force experienced by an object due to gravity. Also, in common usage the "weight" (mass) of an object is what one determines when one "weighs" (masses) an object on a scale or balance.

What is claimed is:

1. An ergonomic multi-positionable workstation, comprising:

a) a base;

b) a stationary frame;

c) a first rotatable support ring;

d) a second rotatable support ring;

e) a seat comprising a hinged center part and a backrest; and f) a support for a work surface, a keyboard, or both a work surface and a keyboard;

wherein the stationary frame b) is attached to the base a);

wherein the seat e) is attached to the first rotatable support ring c);

wherein the support for a work surface, a keyboard, or both a work surface and a keyboard f) is attached to the second rotatable support ring d); and wherein the first rotatable support ring c) and the second rotatable support ring d) are each supported by and rotatable with respect to the stationary frame and are each independently rotatable with respect to each other.

2. A workstation according to claim 1, further comprising:

g) a support for a monitor;

wherein the support for the monitor g) is attached to the second rotatable support ring d); and wherein the support for a work surface, a keyboard, or both a work surface and a keyboard f) and the support for the monitor g) are each independently adjustable with respect to each other.

3. A workstation according to claim 1 wherein the first rotatable support ring c) and the second rotatable support ring d) are each rotatable 360 degrees in either direction about an axis perpendicular to planes defined by the circumferences of each of the rotatable support rings.

4. A workstation according to claim 1 further comprising one or more drive mechanisms h) for rotating the first support ring c) and the second support ring d).

5. A workstation according to claim 4 wherein the drive mechanism is selected from electrical drive mechanisms, mechanical drive mechanisms, and combinations thereof.

6. A workstation according to claim 5 wherein the electrical drive mechanism comprises one or more chains, sprockets, and electric gearbox motors.

7. A workstation according to claim 5 wherein the electrical drive mechanism further comprises one or more belts, rollers, and electric gearbox motors.

8. A workstation according to claim 5 wherein the electrical drive mechanism further comprises one or more racks, pinions, and electric gearbox motors.

9. A workstation according to claim 5 wherein the electrical drive mechanism further comprises a plurality of teeth located on the first rotatable support ring c) and the second rotatable support ring d), one or more gears for engaging the teeth and moving the rotatable support rings, and electric gearbox motors.

10. A workstation according to claim 5 wherein the mechanical drive mechanism comprises one or more manual cranks and shafts.

11. A workstation according to claim 5 wherein the drive mechanism further comprises a braking means.

12. A workstation according to claim 1 further comprising one or more rollers, bearings, or v-grooved wheels or rings i) on which the first rotatable support ring c) and the second rotatable support ring d) are supported.

13. A workstation according to claim 12 wherein the one or more rollers, bearings, or v-grooved wheels or rings i) are contained within the stationary frame.

14. A workstation according to claim 1 wherein the first rotatable support ring c) and the second rotatable support ring d) are each contained within or partially contained within the stationary frame.

15. A workstation according to claim 1 further comprising a means j) for preventing collision of the seat e), the support for a work surface, a keyboard, or both a work surface and a keyboard f), and the support for a monitor g), with each other and/or with a user of the workstation and/or with the floor or surface on which the workstation is positioned.

16. A workstation according to claim 15 wherein said means j) for preventing collisions comprises one or more sensors.

17. A workstation according to claim 1 wherein the seat e) further comprises armrests.

18. A workstation according to claim 1 wherein the seat e) further comprises leg rests, footrests, or a combination thereof.

19. A workstation according to claim 1 further comprising a means for gripping or restraining the ankles or lower extremities of a user k), particularly when the workstation is positioned such that the user is suspended or reclined.

20. A workstation according to claim 1 further comprising one or more control panels l).

21. A workstation according to claim 20 wherein the one or more control panels l) are located on the armrests.

22. A workstation according to claim 1 further comprising a computerized control system m).

23. A workstation according to claim 1 wherein the base a) further comprises one or more wheels or rollers n) to facilitate moving of the workstation.

24. A workstation according to claim 1 further comprising an illumination source o) to illuminate the work area.

* * * * *